US006010843A

United States Patent [19]

Hoogmartens et al.

[11] Patent Number: 6,010,843

[45] **Date of Patent: *Jan. 4, 2000**

[54] PHOTOTHERMOGRAPHIC RECORDING MATERIAL COMPRISING A HYDRAZINE COMPOUND AND A RECORDING PROCESS THEREFOR

[75] Inventors: Ivan Hoogmartens, Wilrijk; Hans Strijckers, Oudergem; David Terrell, Lint, all of Belgium

[73] Assignee: Agfa-Gevaert N.V., Mortsel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 08/889,485

[22] Filed: Jul. 8, 1997

Related U.S. Application Data

[60] Provisional application No. 60/027,504, Sep. 27, 1996.

[30] Foreign Application Priority Data

Jul. 24, 1996 [EP] European Pat. Off. ..... 96202106

[51] Int. Cl.[7] ..... G03C 1/498

[52] U.S. Cl. ..... 430/619; 430/264; 430/617

[58] Field of Search ..... 430/619, 264, 430/617

[56] References Cited

U.S. PATENT DOCUMENTS

| | | | |
|---|---|---|---|
| 5,496,695 | 3/1996 | Simpson et al. | 430/619 |
| 5,529,889 | 6/1996 | Ueda et al. | 430/353 |
| 5,558,974 | 9/1996 | Loccufier et al. | 430/264 |

*Primary Examiner*—Thorl Chea
*Attorney, Agent, or Firm*—Baker & Botts, L.L.P.

[57] ABSTRACT

A photothermographic recording material comprising a support and a photo-addressable thermally developable element containing a substantially light-insensitive organic silver salt, a reducing agent therefor in thermal working relationship therewith, photosensitive silver halide spectrally sensitized with a dye and in catalytic association with the substantially light-insensitive organic silver salt and a binder, wherein the photo-addressable thermally developable element further includes a hydrazine compound represented by the formula (I):

(I)

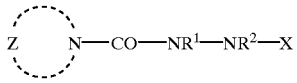

wherein:

Z represents the necessary atoms to close a heterocyclic ring which is either a five-membered ring containing at least two heteroatoms or a six-membered ring, which ring may carry one or more fused-on rings, and which ring must contain a C—H bond permitting oxidative aromatisation to an acylonium group by means of a hydride shift or a consecutive 2-electron-proton transfer; each of $R^1$ and $R^2$ independently represents a hydrogen atom or an alkali-labile group giving rise to a hydrogen atom on hydrolysis; X is an acyl group selected from the group consisting of CO—$R^3$, CS—$R^4$, PO—$R^5R^6$ and (CN—$R^7$)—$R^8$, wherein each of $R^3$ to $R^8$ independently represents alkyl, aryl, cycloalkyl, heterocycloalkyl, heteroaryl, O-alkyl, O-aryl, O-heteroaryl, O-heterocycloalkyl, S-alkyl, S-aryl, S-heterocycloalkyl, S-heteroaryl or N—$R^9R^{10}$, wherein each of $R^9$ and $R^{10}$ independently represents hydrogen, aryl, alkyl, heteroaryl, heterocycloalkyl or acyl as defined for X, and wherein $R^5$ together with $R^6$, and $R^9$ together with $R^{10}$ may represent the necessary atoms to close a ring.

7 Claims, No Drawings

PHOTOTHERMOGRAPHIC RECORDING MATERIAL COMPRISING A HYDRAZINE COMPOUND AND A RECORDING PROCESS THEREFOR

The application claims the benefit of U.S. Provisional Application Ser. No. 60/027,504 filed Sep. 27, 1996.

FIELD OF THE INVENTION

The present invention relates to a photothermographic recording material comprising photosensitive silver halide spectrally sensitized with specific dyes and a recording process therefor.

BACKGROUND OF THE INVENTION

Thermal imaging or thermography is a recording process wherein images are generated by the use of imagewise modulated thermal energy.

In thermography three approaches are known:

1. Direct thermal formation of a visible image pattern by imagewise heating of a recording material containing matter that by chemical or physical process changes colour or optical density.

2. Imagewise transfer of an ingredient necessary for the chemical or physical process bringing about changes in colour or optical density to a receptor element.

3. Thermal dye transfer printing wherein a visible image pattern is formed by transfer of a coloured species from an imagewise heated donor element onto a receptor element.

Thermographic materials of type 1 become photothermographic when a photosensitive agent is present which after exposure to UV, visible or IR light is capable of catalyzing or participating in a thermographic process bringing about changes in colour or optical density. Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991.

In U.S. Pat. No. 5,441,866 it is stated that: "While many of such dyes (dyes which impart spectral sensitivity to a gelatino silver halide element) provide spectral sensitization in photothermographic formulations the dye sensitization is often very inefficient and it is not possible to translate the performance of a dye in gelatino silver halide elements to photothermographic elements."

In the context of infra-red sensitization of "Dry Silver" materials, EP-A 559 228 discloses a photothermographic emulsion comprising a binder, a light insensitive silver salt, a reducing agent for silver ion, and silver halide, the silver halide being spectrally sensitized to radiation of from 750 to 1300 nm and the emulsion containing a supersensitizing amount of a compound selected from the group consisting of heteroaromatic mercapto compounds or heteroaromatic disulfide compounds.

Typical supersensitizers are either dyes or colorless compounds showing strong absorption bands in the near-ultraviolet spectral region associated with electron systems similar to those of the dyes. Sensitization enhancement of a particular spectral sensitizer or class of spectral sensitizers is often only observed with particular compounds or for a narrow class of compounds. Therefore, it is important that the range of compounds available for enhancing the IR-sensitivity of photothermographic recording materials be as large as possible.

OBJECTS OF THE INVENTION

It is a first object of the invention to provide a photothermographic recording material with a high infra-red sensitivity and excellent image-forming properties.

It is a second object of the invention to provide a recording process for a photothermographic recording material with the above improved characteristics.

Further objects and advantages of the invention will become apparent from the description hereinafter.

SUMMARY OF THE INVENTION

According to the present invention, a photothermographic material is provided comprising a photo-addressable thermally developable element containing a substantially light-insensitive organic silver salt, a reducing agent therefor in thermal working relationship therewith, photosensitive silver halide spectrally sensitized with a dye and in catalytic association with the substantially light-insensitive organic silver salt and a binder, wherein the photo-addressable thermally developable element further includes a hydrazine compound represented by the formula (I):

(I)

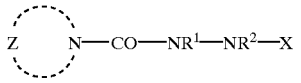

wherein:

Z represents the necessary atoms to close a heterocyclic ring which is either a five-membered ring containing at least two heteroatoms or a six-membered ring, which ring may carry one or more fused-on rings, and which ring must contain a C—H bond permitting oxidative aromatisation to an acyl-onium group by means of a hydride shift or a consecutive 2-electron-proton transfer; each of $R^1$ and $R^2$ independently represents a hydrogen atom or an alkali-labile group giving rise to a hydrogen atom on hydrolysis; X is an acyl group selected from the group consisting of CO—$R^3$, CS—$R^4$, PO—$R^5R^6$ and (CN—$R^7$)—$R^8$, wherein each of $R^3$ to $R^8$ independently represents alkyl, aryl, cycloalkyl, heterocycloalkyl, heteroaryl, O-alkyl, O-aryl, O-heteroaryl, O-heterocycloalkyl, S-alkyl, S-aryl, S-heterocycloalkyl, S-heteroaryl or N—$R^9R^{10}$, wherein each of $R^9$ and $R^{10}$ independently represents hydrogen, aryl, alkyl, heteroaryl, heterocycloalkyl or acyl as defined for X, and wherein $R^5$ together with $R^6$, and $R^9$ together with $R^{10}$ may represent the necessary atoms to close a ring.

Preferred embodiments of the invention are disclosed in the dependent claims.

DETAILED DESCRIPTION OF THE INVENTION

Hydrazine compound

According to the present invention, a photothermographic recording material is provided comprising a photo-addressable thermally developable element comprising a hydrazine compound corresponding to the general formula (I):

(A)

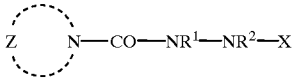

wherein: Z represents the necessary atoms to close a heterocyclic ring which is either a five-membered ring containing at least two heteroatoms or a six-membered ring, which ring may carry one or more fused-on rings, and which ring must contain a C—H bond permitting oxidative aromatisation to an acyl-onium group by means of a hydride shift or a consecutive 2-electron-proton transfer; each of $R^1$ and $R^2$ independently represents a hydrogen atom or an alkali-labile group giving rise to a hydrogen atom on hydrolysis; X is an acyl group selected from the group consisting of CO—$R^3$, CS—$R^4$, PO—$R^5R^6$ and (CN—$R^7$)—$R^8$, wherein each of $R^3$ to $R^8$ independently represents alkyl, aryl, cycloalkyl, heterocycloalkyl, heteroaryl, O-alkyl, O-aryl, O-heteroaryl, O-heterocycloalkyl, S-alkyl, S-aryl, S-heterocycloalkyl, S-heteroaryl or N—$R^9R^{10}$, wherein each of $R^9$ and $R^{10}$ independently represents hydrogen, aryl, alkyl, heteroaryl, heterocycloalkyl or acyl as defined for X, and wherein $R^5$ together with $R^6$, and $R^9$ together with $R^{10}$ may represent the necessary atoms to close a ring.

Hydrazine compounds, according to the present invention, wherein the heterocyclic ring is chosen from the group consisting of pyridine, imidazole, thiazole, pyrazine, N-alkylpyrrole, oxazole, pyrimidine, N-alkyltriazole, oxadiazole, thiadiazole, pyridiazines, isoxazoles, isothiazoles and selenazoles are preferred and hydrazine compounds in which the heterocyclic ring is selected from the group consisting of isoquinoline and benzimidazole are particularly preferred.

All the above-defined R-groups, the heterocyclic rings and heterocyclic rings with fused-on rings may also be substituted.

A particularly preferred hydrazine compound, according to the present invention, corresponds to the formula

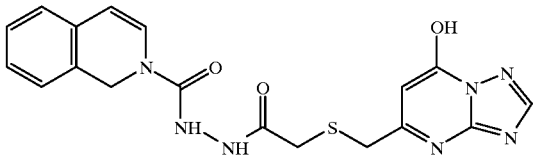

Examples of particularly interesting subclasses of general formula (I) are listed below (wherein R represents H or any substituent in the heterocyclic rings):

structures derived from pyridine, optionally with fused-on rings; for example:

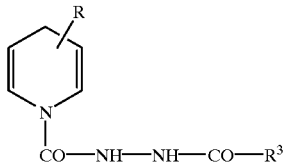

-continued

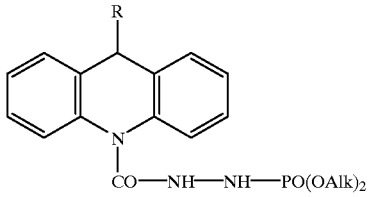

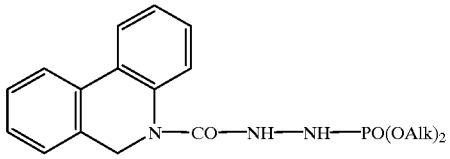

derivatives of imidazoles, optionally with fused-on rings; for example:

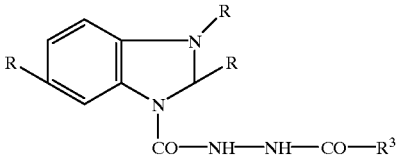

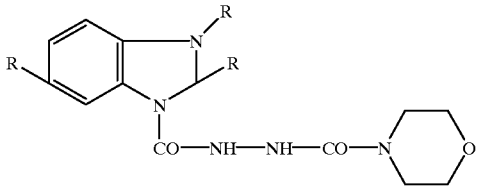

derivatives of thiazoles, optionally with fused-on rings; for example:

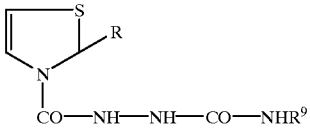

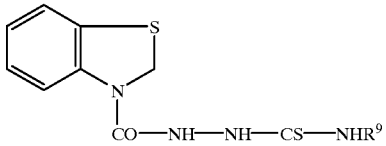

derivatives of pyrazines, optionally with fused-on rings; for example:

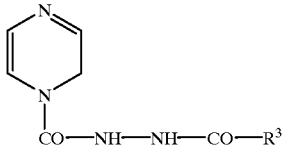

-continued

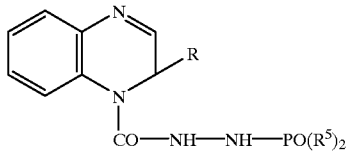

N-alkylpyrrole derivatives, optionally with fused-on rings; for example:

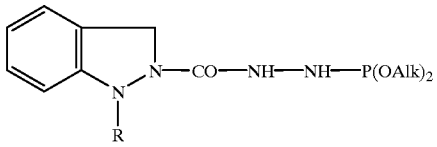

derivatives of oxazoles, optionally with fused-on rings; for example:

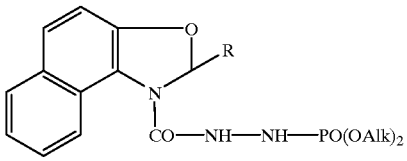

pyrimidine derivatives, optionally with fused-on rings; for example:

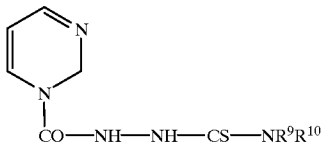

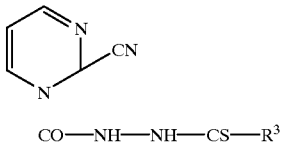

derivatives of oxadiazoles; for example:

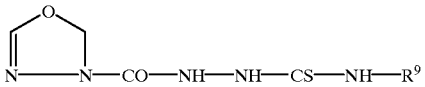

derivatives of thiadiazoles; for example:

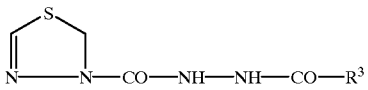

derivatives of pyridiazines, optionally with fused-on rings; for example:

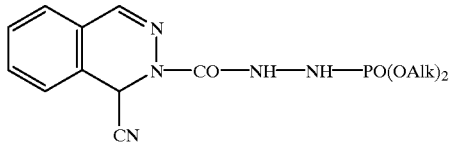

derivatives of isoxazoles and isothiazoles and analogous compounds; for example:

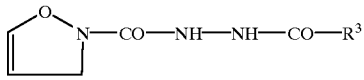

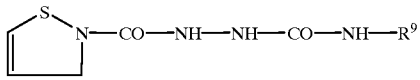

The synthesis of representative compounds, according to the present invention, is described in EP-A 671 654.

The choice of hydrazine compound and molar ratio of hydrazine compound to IR-sensitizing dye is dependent upon the choice of IR-sensitizing dye and the medium from which the layer of the photo-addressable thermally developable element is coated. Suitable hydrazine compounds for use according to the present invention are:

* HYD 01:

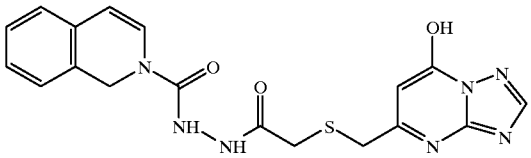

* HYD 02:

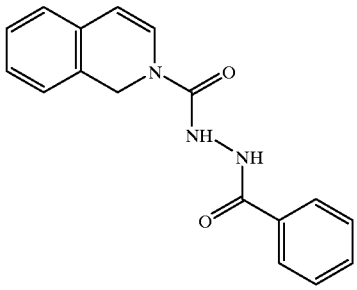

* HYD 03:

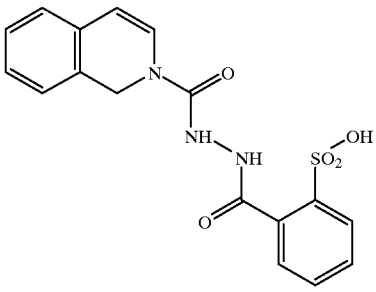

-continued

* HYD 04:

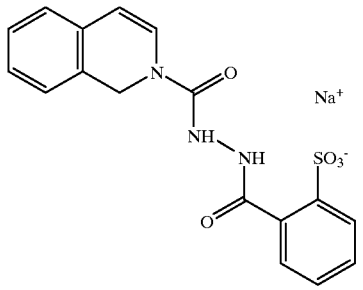

* HYD 05:

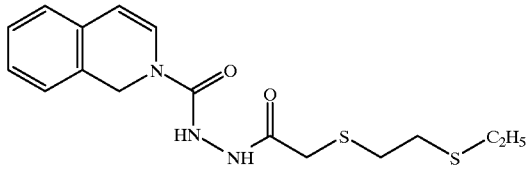

Spectral sensitizer

The photo-addressable thermally developable element of the photothermographic recording material, according to the present invention, contain a spectral sensitizer for silver halide and a hydrazine compound. The silver halide may be spectrally sensitized with various known dyes including cyanine, merocyanine, styryl, hemicyanine, oxonol, hemioxonol and xanthene dyes, particularly in the case of sensitization to infra-red radiation, in the presence of a hydrazine compound, according to the present invention. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Suitable sensitizers of silver halide to infra-red radiation include those disclosed in the EP-A's 465 078, 559 101, 616 014 and 635 756, the JN's 03-080251, 03-163440, 05-019432, 05-072662 and 06-003763 and the U.S. Pat. Nos. 4,515,888, 4,639,414, 4,713,316, 5,258,282 and 5,441, 866.

Photo-addressable thermally developable element

The photo-addressable thermally developable element, according to the present invention, contains a substantially light-insensitive organic silver salt, photosensitive silver halide in catalytic association therewith and an organic reducing agent in thermal working relationship with the substantially light-insensitive organic silver salt and a binder. The element may comprise a layer system with the silver halide in catalytic association with the substantially light-insensitive organic silver salt ingredients, spectral sensitizer optionally together with a hydrazine compound in intimate sensitizing association with the silver halide particles and the other ingredients active in the thermal development process or pre- or post-development stabilization of the element being in the same layer or in other layers with the proviso that the organic reducing agent and the toning agent, if present, are in thermal working relationship with the substantially light-insensitive organic silver salt i.e. during the thermal development process the reducing agent and the toning agent, if present, are able to diffuse to the substantially light-insensitive organic silver salt.

Substantially light-insensitive organic silver salts

Preferred substantially light-insensitive organic silver salts according to the present invention are silver salts of organic carboxylic acids in particular aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps"; silver dodecyl sulphonate described in U.S. Pat. No. 4,504,575; and silver di-(2-ethylhexyl)-sulfosuccinate described in EP-A 227 141. Modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

The term substantially light-insensitive organic silver salt for the purposes of the present invention also includes mixtures of organic silver salts.

Photosensitive silver halide

The photosensitive silver halide used in the present invention may be employed in a range of 0.75 to 25 mol percent and, preferably, from 2 to 20 mol percent of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

Emulsion of organic silver salt and photosensitive silver halide

A suspension of particles containing a substantially light-insensitive silver salt of an organic carboxylic acid may be obtained by using a process, comprising simultaneous metered addition of an aqueous solution or suspension of an organic carboxylic acid or its salt; and an aqueous solution of a silver salt to an aqueous liquid, as described in EP-A 754 969.

The silver halide may be added to the photo-addressable thermally developable element in any fashion which places it in catalytic proximity to the substantially light-insensitive organic silver salt. Silver halide and the substantially light-insensitive organic silver salt which are separately formed, i.e. ex-situ or "preformed", in a binder can be mixed prior to use to prepare a coating solution, but it is also effective to blend both of them for a long period of time. Furthermore, it is effective to use a process which comprises adding a halogen-containing compound to the organic silver salt to partially convert the substantially light-insensitive organic silver salt to silver halide as disclosed in U.S. Pat. No. 3,457,075.

A particularly preferred mode of preparing the emulsion of organic silver salt and photosensitive silver halide for coating of the photo-addressable thermally developable element from solvent media, according to the present invention is that disclosed in U.S. Pat. No. 3,839,049, but other methods such as those described in Research Disclosure, June 1978, item 17029 and U.S. Pat. No. 3,700,458 may also be used for producing the emulsion.

A particularly preferred mode of preparing the emulsion of organic silver salt and photosensitive silver halide for coating of the photo-addressable thermally developable element from aqueous media, according to the present invention is that disclosed in unpublished PCT patent application PCT/EP/96/02580, which discloses a photothermographic recording material comprising a photo-addressable thermally developable element comprising a substantially light-insensitive organic silver salt, photosensitive silver halide in catalytic association with the substantially light-insensitive organic silver salt, a reducing agent in thermal working relationship with the substantially light-insensitive organic silver salt and a binder, characterized in that the binder comprises a water-soluble polymer, a water-dispersible polymer or a mixture of a water-soluble polymer and a water-dispersible polymer and particles of the photosensitive silver halide are non-aggregating in the photo-addressable thermally developable element and are uniformly distributed over and between particles of the substantially light-insensitive organic silver salt, at least 80% by number of the particles havig a diameter, determined by transmission electron microscopy, of ≦40 nm.

Organic reducing agent for photo-addressable thermally developable elements coated from non-aqueous media Suitable organic reducing agents for the reduction of the substantially light-insensitive organic heavy metal salts in photo-addressable thermally developable coated from non-aqueous media are organic compounds containing at least one active hydrogen atom linked to O, N or C, such as is the case with, mono-, bis-, tris- or tetrakis-phenols; mono- or bis-naphthols; di- or polyhydroxy-naphthalenes; di- or polyhydroxybenzenes; hydroxymonoethers such as alkoxynaphthols, e.g. 4-methoxy-1-naphthol described in U.S. Pat. No. 3,094,41; pyrazolidin-3-one type reducing agents, e.g. PHENIDONE (tradename); pyrazolin-5-ones; indan-1,3-dione derivatives; hydroxytetrone acids; hydroxytetronimides; 3-pyrazolines; pyrazolones; reducing saccharides; aminophenols e.g. METOL (tradename); p-phenylenediamines, hydroxylamine derivatives such as for example described in U.S. Pat. No. 4,082,901: reductones e.g. ascorbic acids; hydroxamic acids; hydrazine derivatives; amidoximes; n-hydroxyureas; and the like, see also U.S. Pat. Nos. 3,074,809, 3,080,254, 3,094,417 and 3.887,378.

Polyphenols such as the bisphenols used in the 3M Dry Silver™ materials, sulfonamide phenols such as used in the Kodak Dacomatic™ materials, and naphthols are particularly preferred for photothermographic recording materials with photo-addressable thermally developable elements on the basis of photosensitive silver halide/organic silver salt/reducing agent.

Organic reducing agent for photo-addressable thermally developable elements coated from aqueous media Suitable organic reducing agents for the reduction of the substantially light-insensitive organic heavy metal salts in photo-addressable thermally developable coated from aqueous media are organic compounds containing at least one active hydrogen atom linked to O, N or C. Particularly suitable organic reducing agents for the reduction of the substantially light-insensitive organic silver salt in such photo-addressable thermally developable elements are non-sulfo-substituted 6-membered aromatic or heteroaromatic ring compounds with at least three substituents one of which is a hydroxy group at a first carbon atom and a second of which is a hydroxy or amino-group substituted on a second carbon atom one, three or five ring atoms removed in a system of conjugated double bonds from the first carbon atom in the compound, in which (i) the third substituent may be part of an annulated carbocyclic or heterocyclic ring system; (ii) the third substituent or a further substituent is not an aryl- or oxo-aryl-group whose aryl group is substituted with hydroxy-, thiol- or amino-groups; and (iii) the third substituent or a further substituent is a non-sulfo-electron withdrawing group if the second substiuent is an amino-group.

Particularly preferred reducing agents are substituted catechols or substitued hydroquinones with 3-(3',4'-dihydroxyphenyl)-propionic acid, 3',4'-dihydroxybutyrophenone, methyl gallate, ethyl gallate and 1,5-dihydroxy-naphthalene being especially preferred.

During the thermal development process the reducing agent must be present in such a way that it is able to diffuse to the substantially light-insensitive organic silver salt particles so that reduction of the substantially light-insensitive organic silver salt can take place.

Molar ratio of reducing agent:organic silver salt

The silver image density depends on the coverage of the above defined reducing agent(s) and organic silver salt(s) and has to be preferably such that, on heating above 80° C., an optical density of at least 1.5 can be obtained. Preferably at least 0.10 moles of reducing agent per mole of organic heavy metal salt is used.

Auxiliary reducing agents

The above mentioned reducing agents, regarded as primary or main reducing agents, may be used in conjunction with so-called auxiliary reducing agents. Auxiliary reducing agents that may be used in conjunction with the above mentioned primary reducing agents are sulfonyl hydrazide reducing agents such as disclosed in U.S. Pat. No. 5,464,738, trityl hydrazides and formyl-phenyl-hydrazides such as disclosed in U.S. Pat. No. 5,496,695 and organic reducing metal salts, e.g. stannous stearate described in U.S. Pat. Nos. 3,460,946 and 3,547.648.

Binder

The film-forming binder for the photo-addressable thermally developable element according to the present invention may be coatable from a solvent or aqueous dispersion medium.

The film-forming binder for the photo-addressable thermally developable element according to the present invention may be coatable from a solvent dispersion medium, according to the present invention, may be all kinds of natural, modified natural or synthetic resins or mixtures of such resins, wherein the organic silver salt can be dispersed homogeneously: e.g. polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. A particularly suitable polyvinyl butyral containing a minor amount of vinyl alcohol units is marketed by MONSANTO USA under the trade names BUTVAR™ B76 and BUTVAR™ B79 and provides a good adhesion to paper and properly subbed polyester supports.

The film-forming binder for the photo-addressable thermally developable element coatable from an aqueous dispersion medium, according to the present invention, may be all kinds of transparent or translucent water-dispersible or water soluble natural, modified natural or synthetic resins or mixtures of such resins, wherein the organic silver salt can be dispersed homogeneously for example proteins, such as gelatin and gelatin derivatives (e.g. phthaloyl gelatin), cellulose derivatives, such as carboxymethylcellulose, polysaccharides, such as dextran, starch ethers etc., galactomannan, polyvinyl alcohol, polyvinylpyrrolidone, acrylamide polymers, homo- or co-polymerized acrylic or methacrylic acid, latexes of water dispersible polymers, with or without hydrophilic groups, or mixtures thereof. Polymers with hydrophilic functionality for forming an aqueous polymer dispersion (latex) are described e.g. in U.S. Pat. No. 5,006,451, but serve therein for forming a barrier layer preventing unwanted diffusion of vanadium pentoxide present as an antistatic agent.

Weight ratio of binder to organic silver salt

The binder to organic heavy metal salt weight ratio is preferably in the range of 0.2 to 6, and the thickness of the photo-addressable thermally developable element is preferably in the range of 5 to 50 μm.

Thermal solvents

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic heavy metal salt, at a temperature above 60° C.

Toning agent

In order to obtain a neutral black image tone in the higher densities and neutral grey in the lower densities the photo-addressable thermally developable element contains preferably in admixture with the organic heavy metal salts and reducing agents a so-called toning agent known from thermography or photothermography.

Suitable toning agents are succinimide and the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type as described in GB-P 1,439,478 and U.S. Pat. No. 3,951,660.

Stabilizers and antifoggants

In order to obtain improved shelf-life and reduced fogging, stabilizers and antifoggants may be incorporated into the photothermographic materials of the present invention. Examples of suitable stabilizers and antifoggants and their precursors, which can be used alone or in combination, include the thiazolium salts described in U.S. Pat. Nos. 2,131,038 and 2,694,716; the azaindenes described in U.S. Pat. Nos. 2,886,437 and 2,444,605; the urazoles described in U.S. Pat. No. 3,287,135; the sulfocatechols described in U.S. Pat. No. 3,235,652; the oximes described in GB-P 623,448; the thiuronium salts described in U.S. Pat. No. 3,220,839; the palladium, platinum and gold salts described in U.S. Pat. Nos. 2,566,263 and 2,597,915; the tetrazolyl-thio-compounds described in U.S. Pat. No. 3,700,457; the mesoionic 1,2,4-triazolium-3-thiolate stablizer precursors described in U.S. Pat. Nos. 4,404,390 and 4,351,896; the tribromomethyl ketone compounds described in EP-A 600 587; the combination of isocyanate and halogenated compounds described in EP-A 600 586; the vinyl sulfone and β-halo sulfone compounds described in EP-A 600 589; and those compounds mentioned in this context in Chapter 9 of "Imaging Processes and Materials, Neblette's 8th edition", by D. Kloosterboer, edited by J. Sturge, V. Walworth and A. Shepp, page 279, Van Nostrand (1989); in Research Disclosure 17029 published in June 1978; and in the references cited in all these documents.

Other additives

In addition to the ingredients the photo-addressable thermally developable element may contain other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE Ö1 A (tradename of BAYER AG—GERMANY), ultraviolet light absorbing compounds, white light reflecting and/or ultraviolet radiation reflecting pigments, silica, colloidal silica, fine polymeric particles [e.g. of poly(methylmethacrylate)] and/or optical brightening agents.

Antihalation dyes

According to a preferred embodiment of the present invention, the photothermographic recording material further comprises an antihalation or acutance dye which absorbs light which has passed through the photosensitive layer, thereby preventing its reflection. Such dyes may be incorporated into the photo-addressable thermally developable element or in any other layer comprising the photothermographic recording material of the present invention. The antihalation dye may also be bleached either thermally during the thermal development process or photo-bleached after removable after the thermal development process and it may be contained in a layer which can be removed subsequent to the exposure process. Suitable antihalation dyes for use with infra-red light are described in the EP-A's 377 961 and 652 473, the EP-B's 101 646 and 102 781 and the U.S. Pat. Nos. 4,581,325 and 5,380,635.

Support

The support for the photothermographic recording material according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, corona and flame treated polypropylene, polystyrene, polymethacrylic acid ester, polycarbonate or polyester, e.g. polyethylene terephthalate or polyethylene naphthalate as disclosed in GB 1,293,676, GB 1,441,304 and GB 1,454,956. For example. a paper base substrate is present which may contain white reflecting pigments, optionally also applied in an interlayer between the recording material and the paper base substrate.

The support may be in sheet, ribbon or web form and subbed if need be to improve the adherence to the thereon coated thermosensitive recording layer. The support may be made of an opacified resin composition, e.g. polyethylene terephthalate opacified by means of pigments and/or microvoids and/or coated with an opaque pigment-binder layer, and may be called synthetic paper, or paperlike film; information about such supports can be found in EP's 194 106 and 234 563 and U.S. Pat. Nos. 3,944,699, 4,187,113, 4,780,402 and 5,059,579. Should a transparent base be used, the base may be colourless or coloured, e.g. having a blue colour.

One or more backing layers may be provided to control physical properties such as curl or static.

Protective layer

According to a preferred embodiment of the photothermographic recording material of the present invention, the photo-addressable thermally developable element is provided with a protective layer to avoid local deformation of the photo-addressable thermally developable element, to improve its resistance against abrasion and to prevent its direct contact with components of the apparatus used for thermal development.

This protective layer may have the same composition as an anti-sticking coating or slipping layer which is applied in thermal dye transfer materials at the rear side of the dye donor material or protective layers used in materials for direct thermal recording.

The protective layer preferably comprises a binder, which may be solvent soluble (hydrophobic), solvent dispersible, water soluble (hydrophilic) or water dispersible. Among the hydrophobic binders cellulose acetate butyrate, polymethylmethacrylate and polycarbonates, for example as described in EP-A 614 769, are particularly preferred. Suitable hydrophilic binders are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

A protective layer of the photothermographic recording material, according to the present invention, may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethylorthosilicate and tetraethylorthosilicate being preferred.

A protective layer according to the present invention may comprise in addition at least one solid lubricant having a melting point below 150° C. and at least one liquid lubricant in a binder, wherein at least one of the lubricants is a phosphoric acid derivative, further dissolved lubricating material and/or particulate material, e.g. talc particles, optionally protruding from the outermost layer. Examples of suitable lubricating materials are surface active agents, liquid lubricants, solid lubricants which do not melt during thermal development of the recording material, solid lubricants which melt (thermomeltable) during thermal development of the recording material or mixtures thereof. The lubricant may be applied with or without a polymeric binder.

Such protective layers may also comprise particulate material, e.g. talc particles, optionally protruding from the protective outermost layer as described in WO 94/11198. Other additives can also be incorporated in the protective layer e.g. colloidal particles such as colloidal silica.

Antistatic layer

In a preferred embodiment the recording material of the present invention an antistatic layer is applied to the outermost layer on the side of the support not coated with the photo-addressable thermally developable element. Suitable antistatic layers therefor are described in EP-A's 444 326, 534 006 and 644 456, U.S. Pat. Nos. 5,364,752 and 5,472,832 and DOS 4125758.

Coating

The coating of any layer of the photothermographic recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Photothermographic recording process

Photothermographic materials, according to the present invention, may be exposed with radiation of wavelength between an X-ray wavelength and a 5 microns wavelength with the image either being obtained by pixel-wise exposure with a finely focussed light source, such as a CRT light source; a UV, visible or NR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

According to the present invention a photothermographic recording process is also provided comprising the steps of: (i) image-wise exposing a photothermographic recording material, as referred to above, with actinic radiation to which the photothermographic recording material is sensitive; and (ii) thermally developing the image-wise exposed photothermographic recording material.

Applications

The photothermographic recording materials of the present invention can be used for both the production of transparencies and reflection type prints. This means that the support will be transparent or opaque, e.g. having a white light reflecting aspect. For example, a paper base substrate is present which may contain white reflecting pigments, optionally also applied in an interlayer between the recording material and the paper base substrate. Should a transparent base be used, the base may be colourless or coloured, e.g. has a blue colour.

In the hard copy field photothermographic recording materials on a white opaque base are used, whereas in the medical diagnostic field black-imaged transparencies are widely used in inspection techniques operating with a light box.

While the present invention will hereinafter be described in connection with a preferred embodiment thereof, it will be understood that it is not intended to limit the invention to that embodiment. On the contrary, it is intended to cover all alternatives, modifications and equivalents as may be included in the spirit and scope of the invention as defined by the appending claims.

The following ingredients in addition to those mentioned above were used in the photothermographic recording materials of the invention examples and comparative examples:

a) antistatic layer ingredients:

KELZAN™ S: a xanthan gum from MERCK & CO., Kelco Division, USA, which according to Technical Bulletin DB-19 is a polysaccharide containing mannose, glucose and glucuronic repeating units as a mixed potassium, sodium and calcium salt;

PT-dispersion: a dispersion of poly(3,4-ethylenedioxy-thiophene)/polystyrene sulphonic acid produced by the polymerization of 3,4-ethylenedioxy-thiophene in the presence of polystyrene sulphonic acid and ferric sulphate as described in U.S. Pat. No. 5,354,613;

ULTRAVONT™ W: an aryl sulfonate from CIBA-GEIGY;

PERAPRET™ PE40: a 40% aqueous dispersion of polyethylene wax from BASF;

KIESELSOL™ 100F: a 36% aqueous dispersion of colloidal silica from BAYER;

MAT01: 20% aqueous dispersion of particles of crosslinked methylmethacrylate(98% by weight)-stearylmethacrylate (2% by weight)-copolymeric beads with an average particle size of 5.9 μm produced as described in U.S. Pat. No. 4,861,812;

LATEX01: a 12% by weight dispersion of polymethyl methacrylate with an average particle size of 88.8 nm prepared as described in U.S. Pat. No. 5,354,613;

b) photo-addressable thermally developable element ingredients for coating of element:

i) silver behenate/silver halide emulsion layer:

GEL: phthaloylgelatin, type 16875 from ROUSSELOT;

Butvar™ B79: polyvinylbutyral from MONSANTO;

LOWINOX™ 22IB46: 2-propyl-bis(2-hydroxy-3,5-dimethylphenyl)methane from CHEM. WERKE LOWI;

PHP: pyridinium hydrobromide perbromide;

TMPS: tribromomethyl benzenesulfinate;

SENSI 01:

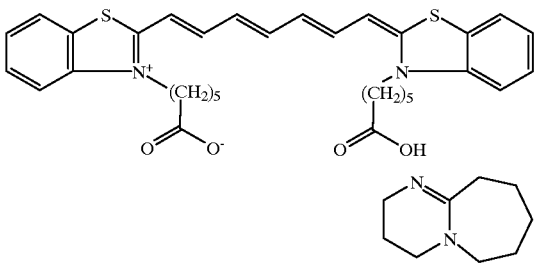

ii) protective layer:

CAB: cellulose acetate butyrate, CAB-171-15S from EASTMAN;

PMMA: polymethylmethacrylate, Acryloid™ K120N from ROHM & HAAS.

The following examples and comparative examples illustrate the present invention. The percentages and ratios used in the examples are by weight unless otherwise indicated.

INVENTION EXAMPLE 1 and COMPARATIVE EXAMPLE 1

Support

A polyethyleneterephthalate (PET) foil was first coated on both sides with a subbing layer consisting of a terpolymer latex of vinylidene chloride-methyl acrylate-itaconic acid (88/10/2) in admixture with colloidal silica (surface area 100 $m^2/g$). After stretching the foil in the transverse direction the foil had a thickness of 175 μm with coverages of the terpolymer and of the silica in the subbing layers of 170 $mg/m^2$ and 40 $mg/m^2$ respectively on each side of the PET-foil.

Antistatic layer

The antistatic layers of the photothermographic recording materials of INVENTION EXAMPLE 1 and COMPARATIVE EXAMPLE 1 were prepared by coating one side of the thus subbed PET-foil with an antistatic composition obtained by dissolving 0.30 g of KELZAN™ S in a stirred mixture of 22.4 mL of N-methylpyrrolidone, 0.84 g of ULTRAVONT™ W, 1 g of PERAPRET™ PE40, 2.22 g of KIESELSOL 100F and 74.3 mL of deionized water and then adding with stirring: 0.2 mL of $NH_4OH$, 0.6 g of dried PT-dispersion, 66.7 ml, of LATEX01, 1.2 mL of MAT01 and 30 mL of 2-propanol to produce a layer after drying at 120° C. consisting of:

| | |
|---|---|
| KELZAN ™ S: | 7.5 $mg/m^2$ |
| Dried PT-dispersion: | 15 $mg/m^2$ |
| ULTRAVON ™ W: | 21 $mg/m^2$ |
| polyethylene wax (from PERAPRET ™ PE40): | 10 $mg/m^2$ |
| colloidal silica (from KIESELSOL ™ 100F): | 20 $mg/m^2$ |
| 5.9 μm beads of crosslinked methylmethacrylate-stearylmethacrylate copolymer (from MAT01): | 6 $mg/m^2$ |
| polymethylmethacrylate (from LATEX01): | 200 $mg/m^2$ |

Silver halide emulsion

A silver halide emulsion consisting of 3.11% by weight of silver halide particles consisting of 97 mol % silver bromide and 3 mol % silver iodide with an weight average particle size of 50 nm, 0.47% by weight of GEL as dispersing agent in deionized water was prepared using conventional silver halide preparation techniques such as described, for example, in T. H. James, "The Theory of the Photographic Process", Fourth Edition, Macmillan Publishing Co. Inc., New York (1977), Chapter 3, pages 88–104.

Silver behenate/silver halide emulsion

The silver behenate/silver halide emulsion was prepared by adding a solution of 6.8 kg of behenic acid in 67 L of 2-propanol at 65° C. to a 400 L vessel heated to maintain the temperature of the contents at 65° C., converting 92% of the behenic acid to sodium behenate by adding with stirring 73.6 L of 0.25M sodium hydroxide in deionized water, then adding with stirring 10.1 kg of the above-described silver halide emulsion at 40° C. and finally adding with stirring 46 L of a 0.4M solution of silver nitrate in deionized water. Upon completion of the addition of silver nitrate the contents of the vessel were allowed to cool and the precipitate filtered off, washed, slurried with water, filtered again and finally dried at 40° C. for 72 hours. 120 g of dried powder containing 10 mol % silver halide and 8.6 mol % behenic acid with respect to silver behenate produced as described above were dispersed in a solution of 19.2 g of Butvar™ B79 in 855.2 g of 2-butanone using a microfluidizer yielding a dispersion with 14% by weight of solids. 142.9 g of Butvar™ B79 were then added to produce a dispersion with 24.8% by weight of solids.

Coating and drying of silver behenate/silver halide emulsion layer

An emulsion layer coating composition for the photothermographic recording materials of INVENTION EXAMPLE 1 and COMPARATIVE EXAMPLE 1 were prepared by adding the following solutions or liquids to 92.4 g of the above-mentioned silver behenate/silver halide emulsion in the following sequence with stirring: 0.8 g of a 11.5% solution of PHP in methanol followed by 2 hours stirring, 0.2 g of a 11% solution of calcium bromide in methanol followed by 30 minutes stirring and a particular weight of a particular IR-sensitizing dye solution of a particular concentration which may also contain a particular hydrazine compound at a particular concentration, as specified for the particular INVENTION EXAMPLE or COMPARATIVE EXAMPLE in table 1 and 1.7 g of methanol followed by 30 minutes stirring. 2.4 g of LOWINOX™ 22IB46 were then added followed by 15 minutes stirring and finally 0.5 g of TMPS followed by 15 minutes stirring, thereby making a total weight of 98.8 g.

The PET-foil subbed and coated with an antistatic layer as described above was then doctor blade-coated at a blade setting of 150 μm on the side of the foil not coated with an antistatic layer with the coating composition to a wet layer thickness of 104 μm, which was dried for 3 minutes at 80° C. on an aluminium plate in a drying cupboard.

TABLE 1

| | IR-sensitizer | | | | hydrazine compound | | |
|---|---|---|---|---|---|---|---|
| | code | Weight of solution [g] | Conc. of solution [% by wt] | mmo/mo AgX | code | Weight of solution [g] | Conc. of solution [% by wt] |
| Invention example number | | | | | | | |
| 1 | SENSI 01 | 0.672 | 0.2 | 1.5 | HYD 01 | * | 16.96 |
| Comparative example number | | | | | | | |
| 1 | SENSI 01 | 0.672 | 0.2 | 1.5 | — | — | — |

*hydrazine compound present in the solution of the IR-sensitizer

Protective layer

A protective layer coating composition for the photothermographic recording materials of INVENTION EXAMPLE 1 and COMPARATIVE EXAMPLE 1 was prepared by dissolving 4.08 g of CAB and 0.16 g of PMMA in 56.1 g of 2-butanone and 5.2 g of methanol adding the following solids with stirring in the following sequence: 0.5 g of phthalazine, 0.2 g of 4-methylphthalic acid, 0.1 g of tetrachlorophthalic acid and 0.2 g of tetrachlorophthalic acid anhydride.

The emulsion layer was then doctor blade-coated at a blade setting of 100 μm with the protective layer coating composition to a wet layer thickness of 70 μm, which after drying for 3 minutes at 80° C. on an aluminium plate in a drying cupboard produced a layer with the following composition:

| | |
|---|---|
| CAB | 4.08 g/m$^2$ |
| PMMA | 0.16 g/m$^2$ |
| Phthalazine | 0.50 g/m$^2$ |
| 4-methylphthalic acid | 0.20 g/m$^2$ |
| tetrachlorophthalic acid | 0.10 g/m$^2$ |
| tetrachlorophthalic acid anhydride | 0.20 g/m$^2$ |

Image-wise exposure and thermal processing

The photothermographic recording materials of INVENTION EXAMPLE 1 and COMPARATIVE EXAMPLE 1 were exposed to a 750W tungsten lamp equipped with a filter only allowing transmission of light with a wavelength ≧775 nm through a filter with optical density varying between 0 and 3.0 in optical density steps of 0.15 for 1 s.

Thermal processing was carried out for 10 s on an aluminum block heated to 121° C. with the backside of the photothermographic recording material in contact with the block. The optical density variation of the resulting wedge images was evaluated with a MACBETH™ TR924 densitometer with a visual filter to produce a sensitometric curve for the photothermographic recording materials.

The $D_{max}$ - and $D_{min}$-values obtained upon image-wise exposure and thermal processing of the photothermographic recording materials of INVENTION EXAMPLE 1 and COMPARATIVE EXAMPLE 1 together with the IR-sensitizer, hydrazine compound, molar ratio of hydrazine compound to IR-sensitizer and the thermal processing conditions used are summarized in table 2.

It is evident from the results in table 2, that the presence of HYD 01 in the photothermographic recording material of INVENTION EXAMPLE 1, according to the present invention, enhances the spectral sensitization in the infra-red region of the spectrum.

TABLE 2

| | IR-sensitizer code | hydrazine compound code | moles hydrazine compound/mol IR-sensitizer | thermal processing conditions temperature [° C.] | time [s] | $D_{max}$ | $D_{min}$ |
|---|---|---|---|---|---|---|---|
| Invention example number | | | | | | | |
| 1 | SENSI 01 | HYD 01 | 95:1 | 121 | 10 | 1.93 | 0.26 |
| Comparative example number | | | | | | | |
| 1 | SENSI 01 | — | — | 121 | 10 | 0.80 | 0.17 |

Having described in detail preferred embodiments of the current invention, it will now be apparent to those skilled in the art that numerous modifications can be made therein without departing from the scope of the invention as defined in the following claims.

We claim:

1. A photothermographic recording material comprising a support and a photo-addressable thermally developable element containing a substantially light-insensitive organic silver salt, a reducing agent therefor in thermal working relationship therewith, photosensitive silver halide spectrally sensitized with a dye and in catalytic association with said substantially light-insensitive organic silver salt and a binder, wherein said photo-addressable thermally developable element further comprises a hydrazine compound represented by the formula (I):

(I)

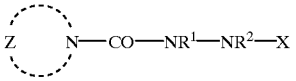

wherein:

Z represents the necessary atoms to close a heterocyclic ring which is either a five-membered ring containing at least two heteroatoms or a six-membered ring, which ring may carry one or more fused-on rings, and which ring must contain a C—H bond permitting oxidative aromatisation to an acylonium group by means of a hydride shift or a consecutive 2-electron-proton transfer; each of $R^1$ and $R^2$ independently represents a hydrogen atom or an alkali-labile group giving rise to a hydrogen atom on hydrolysis; X is an acyl group selected from the group consisting of CO—$R^3$, CS—$R^4$, PO—$R^5R^6$ and (CN—$R^7$)—$R^8$, wherein each of $R^3$ to $R^8$ independently represents alkyl, aryl, cycloalkyl, heterocycloalkyl, heteroaryl, O-alkyl, O-aryl, O-heteroaryl, O-heterocycloalkyl, S-alkyl, S-aryl, S-heterocycloalkyl, S-heteroaryl or N—$R^9R^{10}$, wherein each of $R^9$ and $R^{10}$ independently represents hydrogen, aryl, alkyl, heteroaryl, heterocycloalkyl or acyl as defined for X, and wherein $R^5$ together with $R^6$, and $R^9$ together with $R^{10}$ may represent the necessary atoms to close a ring.

2. Photothermographic recording material according to claim 1, wherein said heterocyclic ring is chosen from the group consisting of pyridine, imidazole, thiazole, pyrazine, N-alkylpyrrole, oxazole, pyrimidine, N-alkyltriazole, oxadiazole, thiadiazole, pyridiazines, isoxazoles, isothiazoles and selenazoles.

3. Photothermographic recording material according to claim 2, wherein said heterocyclic ring is selected from the group consisting of isoquinoline and benzimidazole.

4. Photothermographic recording material according to claim 1, wherein said hydrazine compound corresponds to the formula

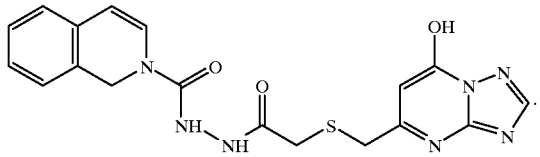

5. Photothermographic recording material according to claim 1, wherein said substantially light-insensitive organic silver salt is a silver salt of an aliphatic carboxylic acid.

6. Photothermographic recording material according to claim 1, wherein said photo-addressable element is provided with a protective layer.

7. Photothermographic recording material according to claim 1, wherein said binder includes a water-soluble binder, a water-dispersible binder or a mixture of a water-soluble and a water-dispersible binder.

* * * * *